US007373765B2

(12) United States Patent
Welchel et al.

(10) Patent No.: US 7,373,765 B2
(45) Date of Patent: May 20, 2008

(54) SHIPPING CARTON WITH PULL TABS AND TEAR STRIP

(75) Inventors: Debra N. Welchel, Woodstock, GA (US); Joseph Mitchell, Alpharetta, GA (US); Richard I. Wolkowicz, Ellenton, FL (US); Ning Yang, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 258 days.

(21) Appl. No.: 10/788,050

(22) Filed: Feb. 26, 2004

(65) Prior Publication Data

US 2005/0189406 A1 Sep. 1, 2005

(51) Int. Cl.
*B65B 43/26* (2006.01)

(52) U.S. Cl. ..... 53/492

(58) Field of Classification Search ..... 229/235, 229/239

See application file for complete search history.

(56) References Cited

U.S. PATENT DOCUMENTS

| | | | | |
|---|---|---|---|---|
| 1,359,895 | A | 11/1920 | Inglis | |
| 2,218,509 | A * | 10/1940 | Goodyear | 229/228 |
| 2,679,349 | A | 5/1954 | Mullinix | |
| 2,967,610 | A | 1/1961 | Ebert et al. | |
| 3,001,644 | A | 9/1961 | Fourness et al. | |
| 3,071,244 | A | 1/1963 | Doran | |
| 3,086,692 | A | 4/1963 | Cage | |
| 3,090,483 | A | 5/1963 | Altree et al. | |
| 3,145,840 | A | 8/1964 | Wright | |
| 3,167,240 | A | 1/1965 | Collura et al. | |
| 3,168,234 | A | 2/1965 | Bartz | |
| 3,276,667 | A | 10/1966 | Johnson et al. | |
| 3,469,766 | A * | 9/1969 | Nelson | 229/235 |
| 3,531,045 | A | 9/1970 | Johnson | |
| 3,884,348 | A | 5/1975 | Ross | |
| 4,008,849 | A | 2/1977 | Baber | |
| 4,039,120 | A | 8/1977 | Herzog | |
| 4,113,100 | A * | 9/1978 | Soja et al. | 229/112 |
| 4,778,057 | A | 10/1988 | Allen et al. | |
| 4,793,487 | A | 12/1988 | Bentsen et al. | |
| 5,361,905 | A | 11/1994 | McQueeny et al. | |
| 5,582,345 | A * | 12/1996 | Lankhuijzen | 229/235 |
| 6,129,211 | A | 10/2000 | Prakken et al. | |
| 6,371,365 | B1 | 4/2002 | Doucette et al. | |
| 6,402,016 | B1 | 6/2002 | Lee | |

(Continued)

FOREIGN PATENT DOCUMENTS

DE 2934493 A1 4/1980

(Continued)

*Primary Examiner*—John Sipos
(74) *Attorney, Agent, or Firm*—Sue C. Watson

(57) ABSTRACT

A shipping carton adapted to hold sheet products in packages is provided. The shipping carton includes a carton having an internal compartment configured to hold packages of sheet products. The carton has a first pull tab and a second pull tab. A tear strip is connected to the first pull tab and it extends about an inner surface of an inner perimeter of the carton to connect to the second pull tab. The tear strip is configured such that when a user pulls as least one of the first and second pull tabs, the carton is separated into two separate containers. A shipping assembly and a method of using a shipping carton are also provided.

15 Claims, 6 Drawing Sheets

U.S. PATENT DOCUMENTS

| | | | |
|---|---|---|---|
| 6,431,363 | B1 | 8/2002 | Hacker |
| 6,481,618 | B2 | 11/2002 | Persson |
| 6,510,982 | B2 | 1/2003 | White et al. |
| 6,554,135 | B1 | 4/2003 | Luceri et al. |

FOREIGN PATENT DOCUMENTS

| | | | |
|---|---|---|---|
| DE | 3122372 | * | 12/1982 |
| EP | 571197 | * | 11/1993 |
| EP | 1103474 | A2 | 5/2001 |
| EP | 1110872 | A1 | 6/2001 |
| EP | 1221415 | A1 | 7/2002 |
| GB | 1028557 | | 3/1964 |
| GB | 2346135 | | 8/2000 |
| GB | 2363372 | | 12/2001 |
| WO | WO98/43890 | | 10/1998 |
| WO | WO 00/50308 | | 8/2000 |
| WO | WO 01/26996 | | 4/2001 |
| WO | WO 01/30659 | | 5/2001 |
| WO | WO 01/87721 | | 11/2001 |
| WO | WO 02/26568 | | 4/2002 |
| WO | WO 02/30765 | | 4/2002 |
| WO | WO 03/11709 | | 2/2003 |

* cited by examiner

SHIPPING CARTON WITH PULL TABS AND TEAR STRIP

BACKGROUND OF THE INVENTION

Sheet products, such as paper towels, facial tissue, commercial wipers, and so forth, are shipped to their final destination in shipping cartons. Such shipping cartons are often large and bulky, so that a great number of packages of sheet products may be contained in each shipping carton.

Cleaning personnel are often required to handle the shipping cartons to obtain the packaged sheet products for distribution to bathrooms, bedrooms, commercial kitchens, and so forth. Therefore, the cleaning personnel must open the shipping cartons and retrieve a sufficient number of packages which are then stacked on cleaning carts for distribution.

The cleaning carts have dimensions such that it is impractical to place large shipping cartons on the cleaning cart. Therefore, the shipping carton may be retained in a utility closet, and so forth, until all of the packaged sheet products are removed. Then, the shipping carton must be disposed of.

The separate packages of sheet products are often stacked on lower shelves of the cleaning cart, so that other items, such as cleaning solutions, wipers, and so forth, are readily accessed on an upper shelf. Such separate packages are easy to knock off of the cleaning cart, or inadvertently opened, and so forth, thereby causing waste.

At times, a group of packaged sheet products are placed in separate boxes, and the boxes are disposed in a shipping carton. However, in this instance, the shipping carton must be opened, each box removed, and the shipping carton discarded. Similarly, each box must be opened to access the packaged sheet products, and each box must be disposed of. While boxes may be sized to fit on a cleaning cart, providing boxes with a shipping carton increases costs.

It would be desirable to have a shipping carton which is configured such that it may be separated into two separate containers. Each container desirably would be configured to fit on the lower shelves of a cleaning cart. Further, each container would provide a large opening to provide easy access to the packaged sheet products. Therefore, the shipping carton would be used to reduce space needed to store the shipping carton. Further such use of a shipping carton would reduce waste of the packaged sheet products by containing and controlling the packaged products in a desirable location on the cleaning cart, while providing easy access and without creating any additional cost.

DEFINITIONS

As used herein, forms of the words "comprise", "have", and "include" are legally equivalent and open-ended. Therefore, additional non-recited elements, functions, steps, or limitations may be present in addition to the recited elements, functions, steps, or limitations.

As user herein, the term "couple", "attach", and "connect" includes, but is not limited to, joining, connecting, fastening, linking, or associating two things integrally or interstitially together.

These terms may be defined with additional language in the remaining portions of the specification.

SUMMARY OF THE INVENTION

In response to the difficulties and problems discussed above, a shipping carton adapted to hold sheet products in packages is provided. The shipping carton includes a carton configured to have a plurality of walls which cooperate to provide an internal compartment configured to hold packages of sheet products. The carton has a first pull tab and a second pull tab positioned in an adjacent and confronting relationship. A tear strip is connected to the first pull tab and it extends about an inner surface of an inner perimeter of the carton to connect to the second pull tab. The tear strip is configured such that when a user pulls as least one of the first and second pull tabs, the carton is separated into two separate containers. Each container is configured to have a plurality of side walls. Each container is configured to be completely filled with packages of sheet products, with no substantial space between packages or between the packages and the container. Each container is formed to include an opening on one side. The opening is configured to have an area larger than an area provided by a smallest side wall of the container.

In another aspect of the invention, a shipping carton adapted to hold sheet products in packages is provided. The shipping carton is convertible into separate containers configured to be disposed on lower shelves of a cleaning cart. The shipping carton includes a carton configured to have a plurality of walls which cooperate to provide an internal compartment configured to hold packages of sheet products. The carton has a first pull tab and a second pull tab positioned in an adjacent and confronting relationship. At least one tear strip is connected to the first pull tab and it extends about an inner surface of an inner perimeter of the carton to connect to the second pull tab. The tear strip is configured such that when a user pulls as least one of the first and second pull tabs, the carton separates into two separate containers. Each container is configured to have a plurality of sidewalls. Each container is configured to be completely filled with packages of sheet products with no substantial space between packages or between the packages and the container. Each container is formed to include an opening on one side thereof. The opening is configured to have an area larger than an area provided by a smallest side wall of the container. Each container is sized to be disposed on a lower shelf of a cleaning cart.

In still another aspect of the invention, a shipping assembly is provided. The shipping assembly includes a shipping carton configured to have a plurality of walls which cooperate to provide an internal compartment configured to hold packages of sheet products. The shipping carton has a first pull tab and a second pull tab positioned in an adjacent and confronting relationship. A tear strip is connected to the first pull tab and it extends about an inner surface of an inner perimeter of the carton to connect to the second pull tab. The tear strip is configured such that when a user pulls as least one of the first and second pull tabs, the carton is separated into two separate containers. Each separate container is configured to have a plurality of side walls. The shipping assembly also includes a plurality of packages of sheet products. Each package has a polygonal configuration. The plurality of packages are disposed in the shipping carton. When the shipping cartons is separated into two containers, each container is configured to be completely filled with packages of sheet products, with no substantial space between packages or between the packages and the container. Each container has an opening on one side. The opening has an area larger than an area provided by a smallest side wall of the container.

In still yet another aspect of the invention, a method of using a shipping carton adapted to hold sheet products in packages is disclosed. The method includes providing a shipping carton configured to have a plurality of walls which cooperate to provide an internal compartment configured to hold packages of sheet products. The carton has a first pull tab and a second pull tab positioned in an adjacent and confronting relationship. A tear strip is connected to the first pull tab and it extends about an inner surface of an inner perimeter of the carton to connect to the second pull tab. The shipping carton is filled with packages of sheet products. The first pull tab is pushed to release the pull tab from a wall of the shipping carton. The second pull tab is pushed to release the pull tab from a wall of the shipping carton. Each first and second pull tab is grasped between a thumb and finger by a user and at least initially each pull tab is pulled in a direction opposite the other such that the tear strip begins separating the shipping carton into two separate containers, each container having side walls. The carton is then separated into two containers and in this manner an opening is provided into each container. The opening in each container has an area larger than an area provided by a smallest side wall of the container. Each container is configured to be completely filled with packages of sheet products with no substantial space between packages or between the packages and the container.

DETAILED DESCRIPTION

Figure 1:
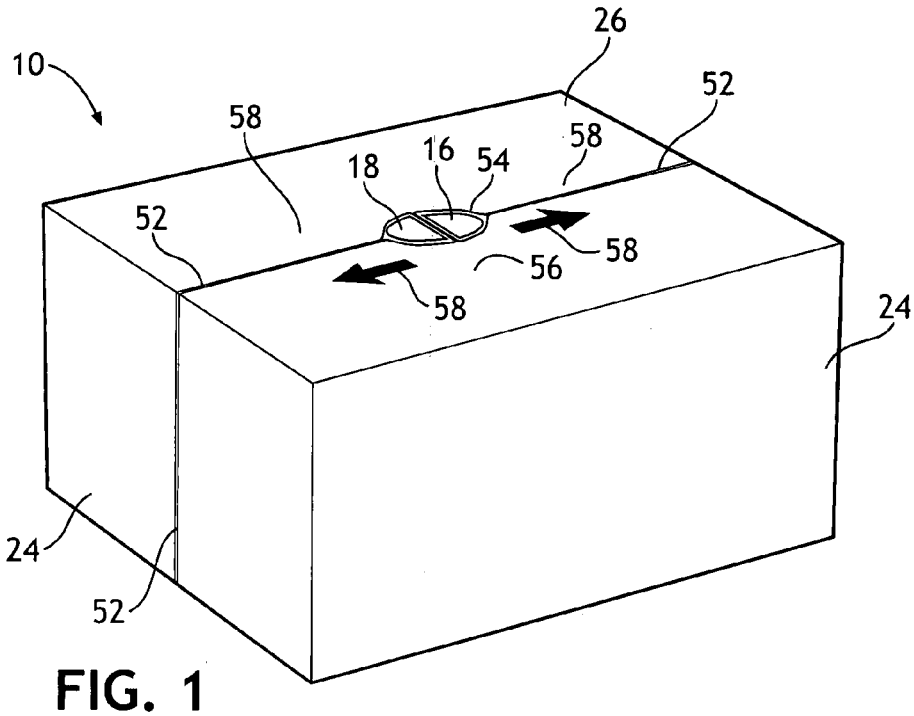
FIG. 1 is a schematic perspective view a shipping carton of the present invention, having pull tabs and pull indicia.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Figure 2:
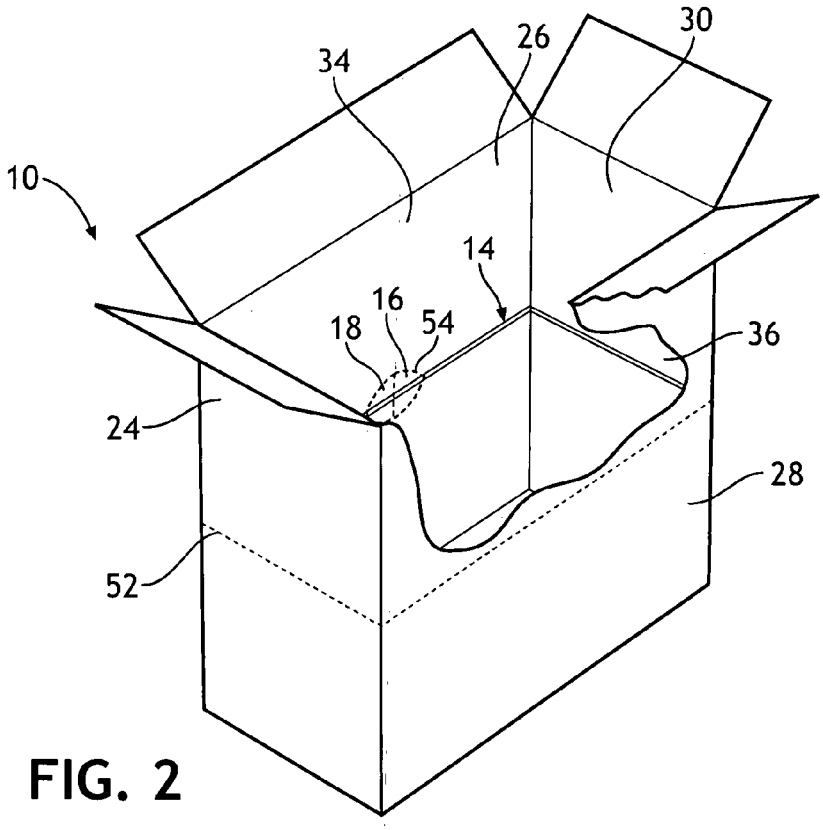
FIG. 2 is a schematic perspective view of the shipping carton of FIG. 1, but showing the carton positioned in an opened and empty position and a portion of the shipping carton being cut away for illustrative purposes only to show the pull tabs and the tear strip's position on an inner surface and about an inner perimeter of the shipping carton, the tear strip's position about the perimeter shown partially by phantom lines.

Referring to FIGS. 1 and 2, a shipping carton 10 configured to hold packages 11 of sheet products (FIGS. 7–9) is provided. The shipping carton 10 is configured to be divided into two separate containers 12 (FIGS. 6–9), by the use of a tear strip 14 having first and second pull tabs 16, 18, as shown in FIGS. 1–5. Once the shipping carton 10 is separated, the two separate containers 12 are each configured to fit on a lower shelf 20 of a standard cleaning cart 22, such as those used in commercial and/or industrial environments, for example, hotels, hospitals, manufacturing facilities, and so forth, as illustrated in FIG. 9.

The sheet products 23 (FIG. 8) provided in the packages 11 (FIGS. 7–9) may include, for example, but not by way of limitation, paper towels, facial tissue, wipers, interfolded sheet toilet tissue, and so forth. Desirably, the packages 11 each have a polygonal shape.

The shipping carton 10, as shown in FIGS. 1 and 2, is formed to include four side walls 24, an upper wall 26, and a lower wall 28. All walls 24, 26, 28 cooperate to provide the generally polygonally-shaped shipping carton 10 and an inner compartment 30 configured to hold packages 11 of sheet products 23. Desirably, the shipping carton 10 has a square and/or rectangular configuration when each side wall 24, upper wall 26 or lower wall 28 is viewed in a plan view. The shipping carton 10 is formed from a flat sheet or blank (not shown) which is folded and connected to provide the shipping carton 10. Blanks to form shipping boxes, shipping cartons, and so forth are known in the art. Therefore, it will be understood that any blank may be used to provide the shipping carton, so long as the resulting shipping carton operates as shown and/or described herein.

The shipping carton 10 is desirably made from cardboard, a cardboard laminate, and so forth. Additional materials may be used with cardboard, which include, but are not limited to, paper, paperboard, flexible plastics, such as polymer film, metal foil, and so forth.

Figure 6:
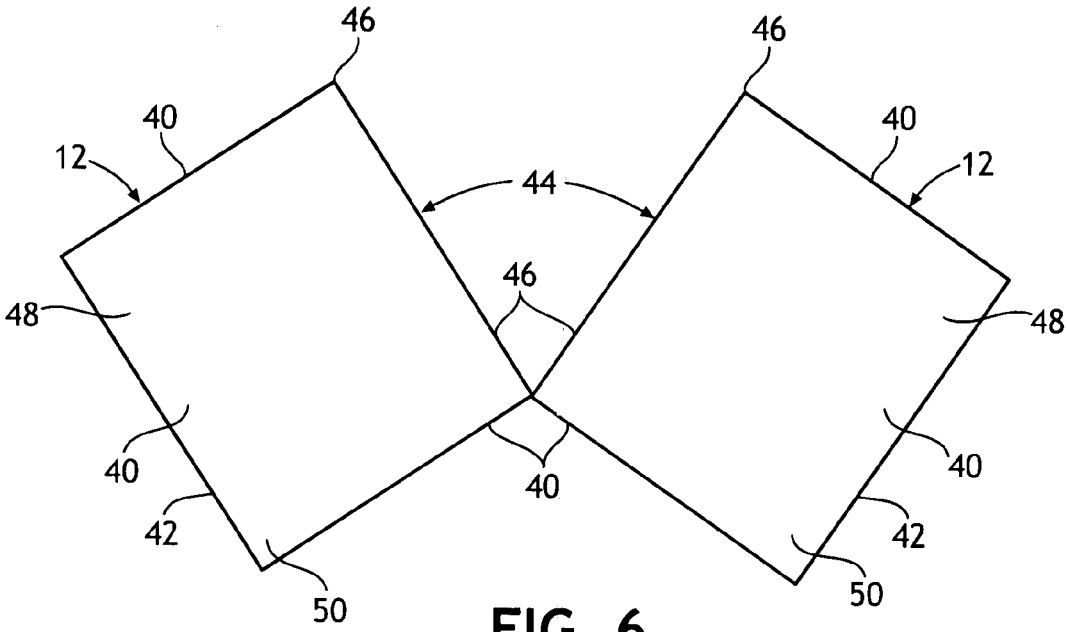
FIG. 6 is a schematic side view of the shipping carton of FIG. 1 as it is being separated into two separate containers.
Figure 7:
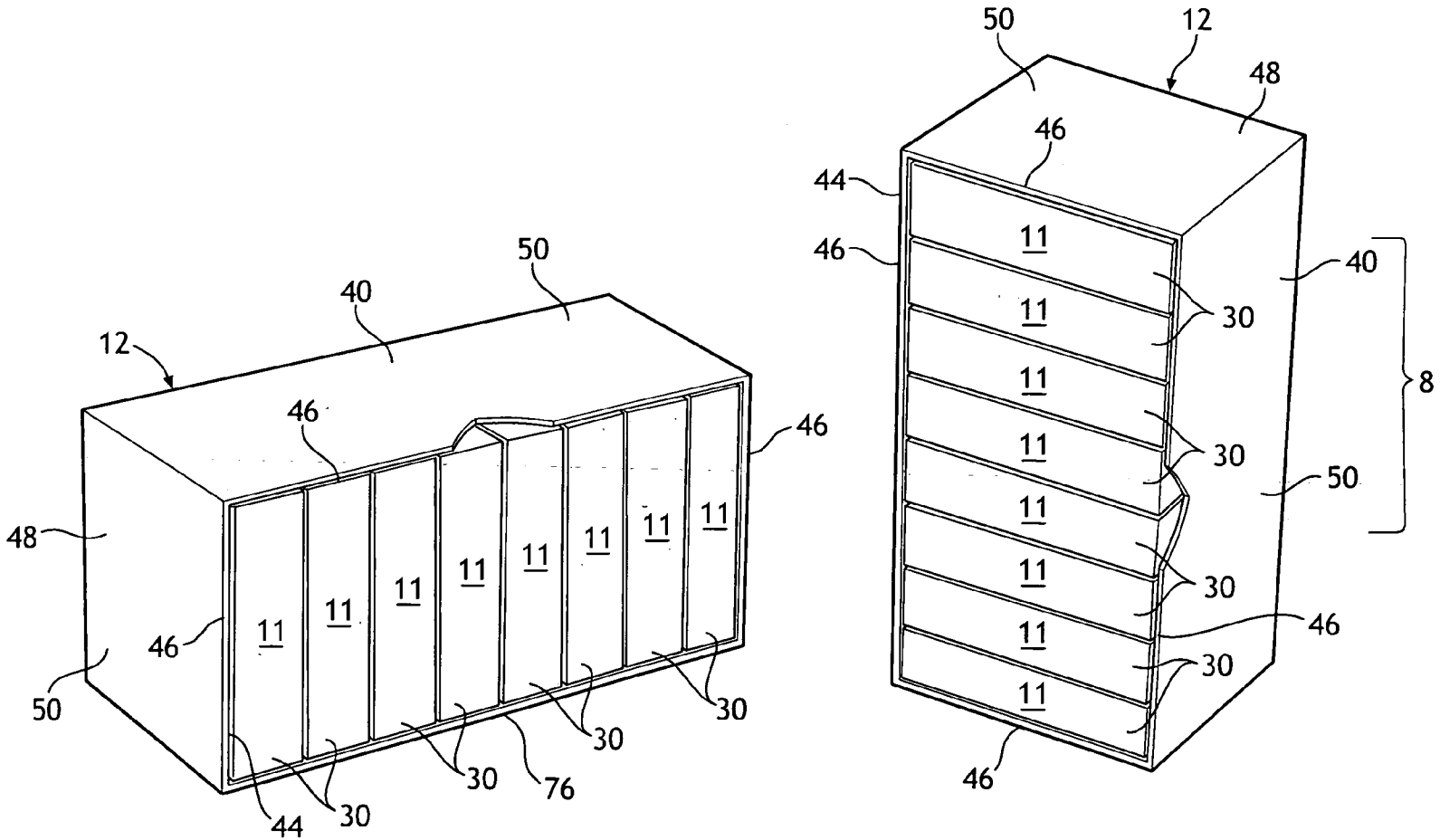
FIG. 7 is a schematic perspective view the two separate containers.
Figure 8:
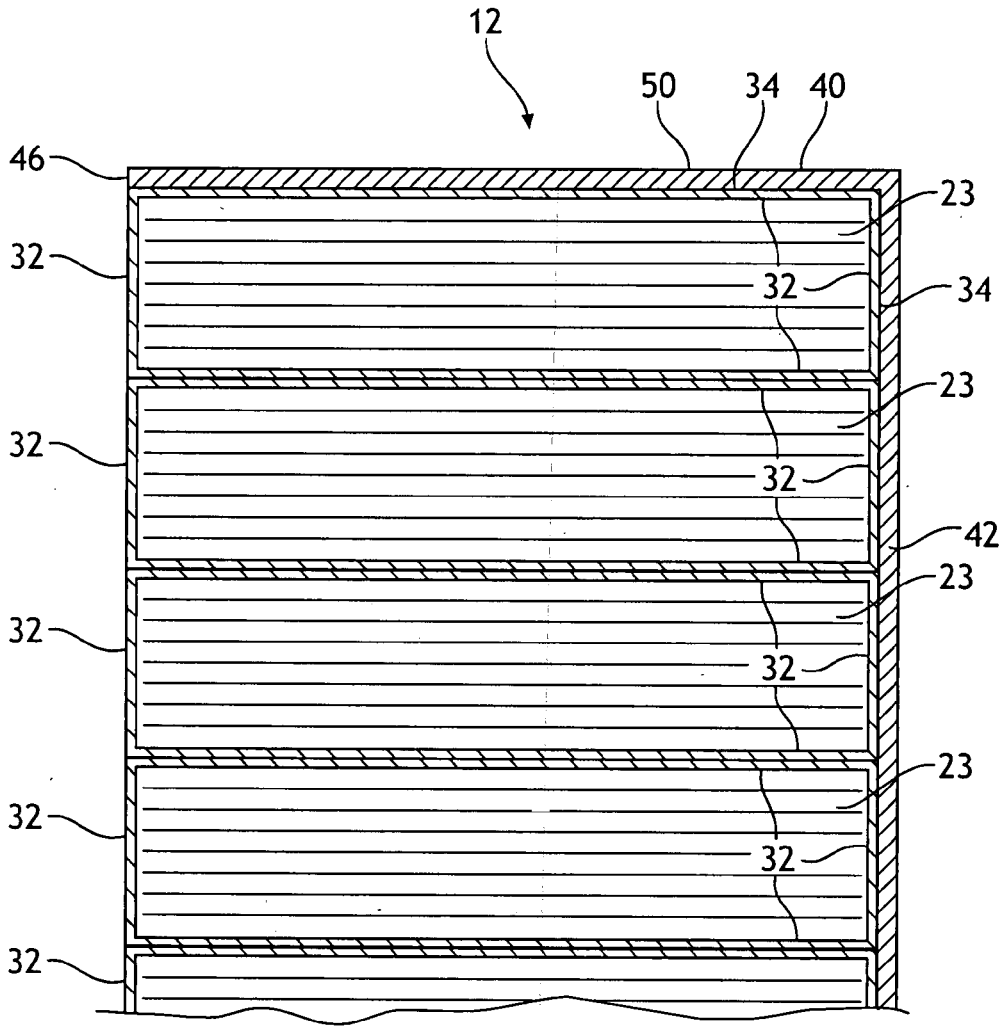
FIG. 8 is a schematic cross-sectional view taken along lines 8—8 of one of the containers of FIG. 7, showing the packages completely filling the container, with no substantial space between packages or between the packages and the container.
Figure 9:
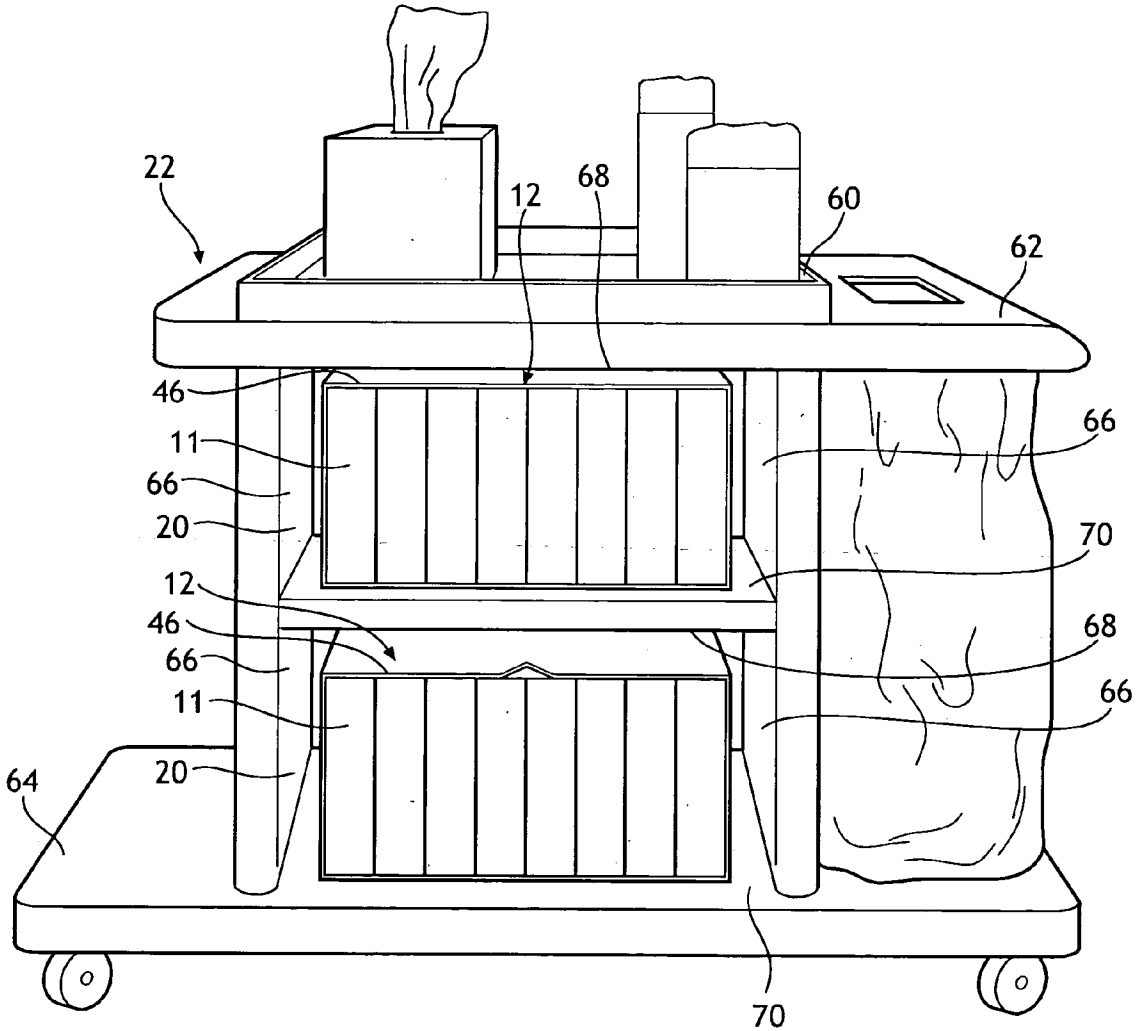
FIG. 9 is a schematic perspective view of the two containers disposed on a standard cleaning cart.

In addition, the shipping carton 10 is configured specifically so that the packages 11 of sheet products 23 disposed therein are divided when the shipping carton 10 is separated into the two separate containers 12, as shown in FIGS. 6–9. Further, each package 11 may be provided as a package which completely covers an outer surface of the sheet products 23 (FIG. 8). Alternatively, however, the package 11 may comprise a band (not shown), which encompasses at least a portion of a group of sheet products. Such a band holds the group of sheet products together, but does not completely cover the sheet products.

Desirably, the sheet products 23 are each packaged in a polygonally-shaped package 11, as shown generally in FIGS. 8 and 9, which cooperates with the shipping carton 10 such that when the packages 11 are positioned in the shipping carton 10, each wall 32 (each wall of each package 11 designated generally by the numeral "32") of each package 11 of sheet products 23 is positioned substantially against another wall 32 of another package 11 of sheet products and/or against a portion of an inner surface 34 of walls 24, 26, 28 of the shipping carton 10, such that no significant space is provided between packages 11 or between the packages 11 and the shipping carton 10, as illustrated in FIG. 8. When the package 11 is a band, it will be understood that both the banded portions and the unbanded portions of the sheet products 23 cooperate to provide walls 32 as described herein. To this end, the shipping carton 10 is desirably completely filled side wall 24 to side wall 24 and upper wall 26 to lower wall 28 with the packages 11 which all substantially touch each other and/or an inner surface 34 of the shipping carton 10.

Figure 3:
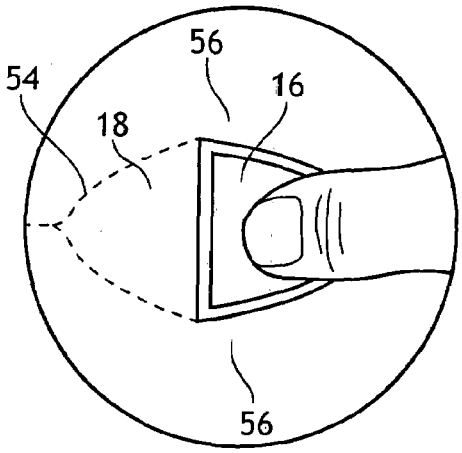
FIG. 3 is a schematic partial top plan view of the shipping carton of FIG. 1, showing a user pushing the first pull tab inward to release the first pull tab from the surrounding perforations.
Figure 4:
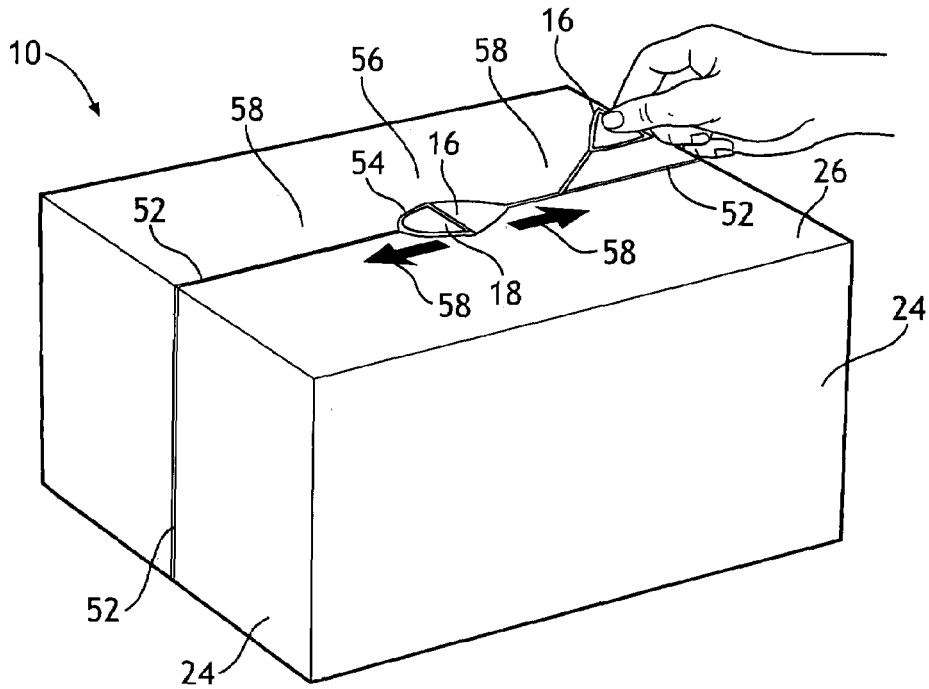
FIG. 4 is a schematic perspective view of the shipping carton of FIG. 1, showing a user grasping the first pull tab and pulling the pull tab such that the tear strip starts to separate the shipping carton.
Figure 5:
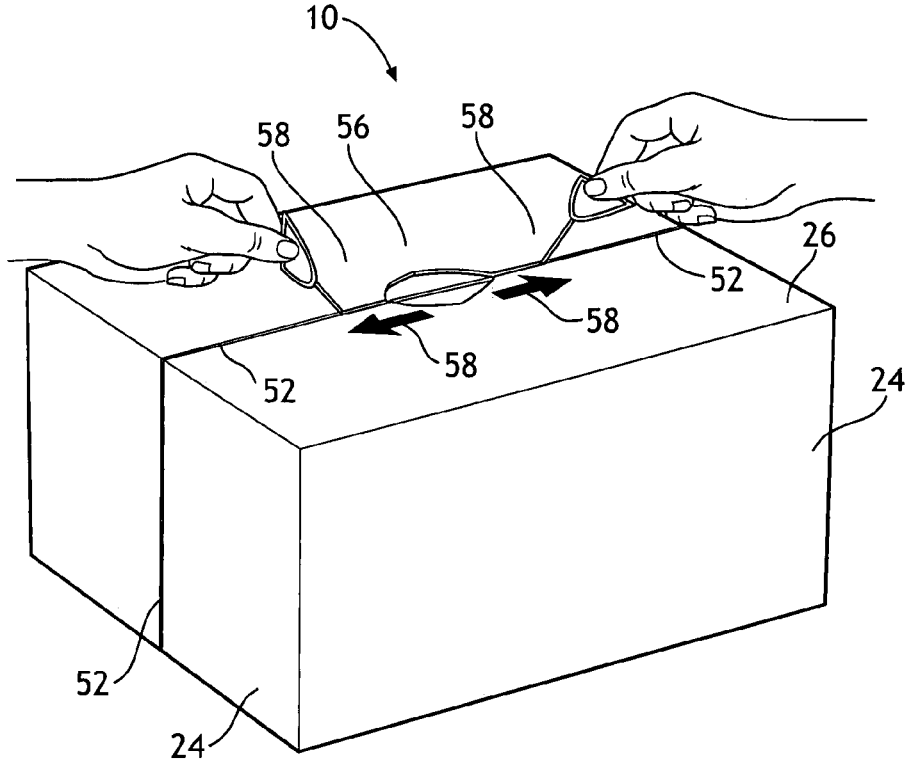
FIG. 5 is a schematic perspective view of the shipping cartons of FIG. 1, showing a user pulling the first pull tab in one direction and the second pull tab in an opposite direction.

The shipping carton 10 is formed to include a tear strip 14 positioned on the inner surface 34 about an inner perimeter 36 of the shipping carton 10, as shown in FIGS. 2, 4 and 5. When the tear strip 14 is activated or pulled by a user pulling one or both of the first and second pull tabs 16, 18, it divides the shipping carton 10 into the two separate containers 12, as illustrated in FIGS. 6, 7, and 9. The shipping carton 10 presently illustrated in FIGS. 1–9 is configured such that, when separated into two containers 12, each container 12 is equal in size and each container 12 has an equal amount of packages 11 provided therein. This embodiment, however, is not intended as a limitation. Therefore, it will be understood that, in an alternative shipping carton (not shown), the shipping carton may be separate into two containers which are not equal in size. In this instance, the large container contains more packages than the smaller container. However, each container of this alternative embodiment is configured to fit on the lower shelves of a cleaning cart. Further, whether equal in size or un-equal, it will be appreciated that the packages will be oriented in the containers as shown and/or described herein.

Turning back to the present embodiment, as illustrated in FIGS. 6–8, each newly-created container 12 has four side walls 40 and an end wall 42 which cooperate to provide each container 12. Each container 12 has one side which is completely open, providing an opening 44 for a user to access the packages 11 therein. The location of the tear strip 14 is oriented such that the opening 44 provided in the container 12 is larger in area than an area of a smallest side wall 48 of the container 12. The packages 11 disposed in each container 12 fill each container 12 completely such that a side wall 32 of each exposed package 11 is coplanar to a newly created top edge 46 of each sidewall 40 of each container 12, as shown in FIGS. 6–8.

The tear strip 14 extends around the inner perimeter 36 of the inner surface 34 shipping carton 10 as illustrated in FIGS. 1 and 2, and its location is designated on an outer surface 50 of the shipping carton by phantom line 52. The tear strip 14 is desirably formed by a tape, line, rope, and so forth, containing strong fibers within it. The tear strip 14 may be formed from a number of different materials, such as, but not by way of limitation, natural or synthetic fiber, plastic, metal wire, any combination(s) thereof, and so forth. It will be understood that material forming the tear strip would normally, but not by way of limitation, be applied to the shipping carton when it is in it flat form as a blank prior to formation. One such tear strip is available from H.B. Fuller Company, Linear Products Division, Vancouver, Wash., sold as OPEN SESAME®. Other tear strips as well as shipping cartons are available from Weyerhaeuser Company, Bowling Green, Ky. The tear strip 14 may be attached to the shipping carton 10 by any method, such as, by way of non-limiting example, adhesive, heat sealing, ultrasonically sealing, laminating, integrally formed with the shipping carton 10, and so forth.

The tear strip 14 includes a pull tab at each end thereof, that is, the first pull tab 16 and the second pull tab 18, as shown in FIGS. 1–5. Each first and second pull tab 16, 18 is desirably, but not by way of limitation, formed as a portion of a wall 24, 26, 28 of the shipping carton 10. In this instance, each pull tab 16, 18 desirably is defined by perforations 54 formed thereabout which permit each pull tab 16, 18 to separate from the wall when released and grasped by a user. Desirably, each pull tab 16, 18 is formed in a middle section 56 of a wall of the shipping carton 10, such as upper wall 26 shown in FIGS. 1–5. In addition, each first and second pull tab 16, 18 desirably includes pull indicia 58 as well. The term "pull indicia", as used herein, means any word(s), numeral(s), line(s), symbol(s), picture(s), and/or combination(s) thereof, and so forth, which indicate to a user the location, release, and method of use of each first and second pull tab 16, 18.

The first and second pull tabs 16, 18 are desirably positioned next to each other in a confronting relationship. When pulled by a user, as shown in FIGS. 4 and 5, one pull tab, such as the first pull tab 16, is pulled in one direction, and the other pull tab, such as the second pull tab 18, is pulled in an opposite direction desirably along the same plane, so that, at least initially, the first and second pull tabs move away from each other at a 180 degree angle. When pulled by an user, each first and second pull tab desirably tears or separates, for example, but not by way of limitation, about one-half of the shipping carton such that the shipping carton is separated into the two separate containers 12, as illustrated in FIGS. 6 and 7.

A first and second pull tab 16, 18 on each end of the tear strip 14 permits a user to quickly and easily operate the tear strip such that it tears evenly and completely, and desirably provides a clean top edge 46 to each side wall 40 of each separate container 12. It has been discovered that a first and second pull tab 16, 18, oriented as shown and described herein, act to permit the tear strip 14 to provide an aesthetically clean and neat separation of the closed shipping carton into the two separate containers 12. Therefore, the containers 12 provide an acceptable appearance to provide on cleaning carts in public locations.

As illustrated in FIG. 3, a user pushes against each pull tab, such as the first pull tab 16, so that the perforations 54 will cause the first pull tab 16 to separate and release from the upper wall 26 of the shipping carton 10. The user then grasps the first pull tab 16 between a thumb and finger(s) to pull the first pull tab 16 and therefore pull the tear strip 14, as shown in FIG. 4. The user pulls the first pull tab 16 and tear strip 14 in a direction opposite of the second pull tab 18, as illustrated in FIG. 5. It will be appreciated that either first or second pull tabs 16, 18 may be released and pulled either sequentially or simultaneously.

Each separate container 12 may include, on the outer surface 50 thereof, design indicia (not shown). "Design indicia", as used herein, may include pictures, symbols, letters, numbers, and any combination(s) thereof, and so forth.

Alternatively, the shipping carton 10 may be identical to that described above, but include two tear strips (not shown). In this alternative, the tear strips are oriented in the same location as previously described for the single tear strip 14, but are only about one-half as long as the previously described tear strip 14. The pull tabs 16, 18 are oriented as previously described. That is, each tear strip has a pull tab, and desirably pull indicia, and each pull tab is oriented in a confronting relationship, as previously described. The length of each tear strip extends only about one-half of the perimeter of the shipping carton. Each first and second pull tab is pulled as described previously, until the end of the tear strip is reached, and the shipping carton is separated into two containers.

Turning back to the present embodiment, the separate containers 12 of the shipping carton 10 are configured to fit on an upper 60 and specifically on the lower shelves 20 of a standard cleaning cart 22, as illustrated in FIG. 9. Standard cleaning carts are desirably on wheels for the convenience of the cleaning personnel. Cleaning carts 22 often include at least two lower shelves 20 positioned below the open upper shelf 60. A garbage bag holder 62 may be provided on a portion of one end of an upper shelf 60. In some embodiments, on an opposite end, the cleaning cart 22 has a lower platform 64 configured to hold large and/or tall objects, such as mop buckets with mops, vacuum cleaners, carpet cleaning machines, and so forth (not shown).

Cleaning personnel must replace sheet products each day in bathrooms, bedrooms, commercial kitchens, and so forth. It is therefore desirable to provide containers 12 that are configured to fit on the lower shelves 20 of the cleaning cart 22. In addition, it is important that such containers 12 are configured to fit between side walls and/or side supports 66 and upper and lower walls 68, 70 of each of the shelves 20 of the cleaning cart 22. Placing each separate package 11 of sheet products onto a shelf of a cleaning cart 22 is time consuming for cleaning personnel. Further, it is easy to inadvertently knock off separate packages, and/or inadvertently open the package 11 or damage the package 11 and cause waste. Each separate container 12 greatly reduces or eliminates that problem. The container 12 securely holds its packages 11, while still providing easy access to users through a sufficiently large opening 44. Further, rather than having to provide separate boxes within the shipping carton 10 to hold a quantity of the packages, the shipping carton 10 separates to perform this function. Further, there is no need to take up space to store the shipping carton 10 until all of the packages 11 are removed.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A method of using a shipping carton adapted to hold packaged sheet products, the method comprising:

providing a shipping carton having a plurality of walls which cooperate to provide an internal compartment configured to hold packages of sheet products, the carton having a first pull tab and a second pull tab positioned in an adjacent and confronting relationship with pull indicia, a tear strip comprising a continuous internal tear strip which includes no perforations into the plurality of walls of the carton, the tear strip connected to the first pull tab and extending about an inner surface of an inner perimeter of the carton to connect to the second pull tab, the shipping carton filled with packages of sheet products;

determining a location of the internal tear strip in the absence of perforations in the shipping carton's walls;

moving the shipping carton into a position for separation of the shipping carton into separate containers via the pull indicia such that the packages of sheet products contained therein will not move out of each separate container as the shipping carton is opened;

pushing the first pull tab to release the pull tab from a sidewall;

pushing the second pull tab to release the pull tab from the sidewall;

grasping each of the pull tabs between a thumb and finger and at least initially pulling the first and second pull tabs in a direction indicated by the pull indicia such that the non-perforated internal tear strip begins separating the shipping carton into two separate containers, each container having side walls and an opening, until only one common sidewall of the shipping carton joins the two containers together;

pivoting one container away from another container by bending the common sidewall such that packages of sheet products contained within each container are positioned such that they will not fall out of the containers;

detaching the tear strip from the containers thereby separating the shipping carton into two separate containers, the opening in each container having an area larger than an area provided by a smallest side wall of the container, each container being configured to be completely filled with packages of sheet products with no substantial space between packages or between the packages and the container.

2. The method of claim 1, wherein in the step of separating the carton into two containers, the packages fill each container such that a side walls of each exposed package is coplanar to a newly created top edge of each sidewall of each container.

3. The method of claim 1, wherein in the step of providing a shipping carton, the first and second pull tab is formed in one of the plurality of walls of the carton.

4. The method of claim 1, wherein in the step of providing a shipping carton, pull indicia is provided on a wall adjacent at least one of the first and second pull tabs.

5. The method of claim 1, wherein in the step of providing a shipping carton, the carton is configured such that, when separated into containers, the containers are configured to fit on lower shelves of a cleaning cart.

6. The method of claim 1, wherein in the step of providing a shipping carton, each of the packages completely covers an outer surface of each of a group of sheet products.

7. The method of claim 1, wherein in the step of providing a shipping carton, each of the packages is further defined as comprising a band.

8. A method of using a shipping carton adapted to hold packaged products, the method comprising:

providing a shipping carton having a plurality of walls which cooperate to provide an internal compartment configured to hold packages, the carton having a first pull tab and a second pull tab positioned in an adjacent and confronting relationship, a tear strip comprising a continuous internal tear strip which includes no perforations into the plurality of walls of the carton, the tear strip connected to the first pull tab and extending about an inner surface of an inner perimeter of the carton to connect to the second pull tab, the shipping carton filled with packages;

pushing the first pull tab to release the first pull tab from a sidewall;

pushing the second pull tab to release the second pull tab from the sidewall;

grasping each of the pull tabs between a thumb and finger and at least initially pulling the first and second pull tabs a direction opposite each other such that the non-perforated internal tear strip begins separating the shipping carton into two separate containers, each container having side walls and an opening, until only one common sidewall of the shipping carton joins the two containers together;

pivoting one container away from another container by bending the common sidewall such that packages of sheet products contained within each container are positioned such that they will not fall out of the containers;

detaching the tear strip from the containers thereby separating the shipping carton into the two separate containers.

9. The method of claim 8, wherein the opening in each container has an area larger than an area provided by a smallest side wall of the container, each container being configured to be completely filled with packages of products with no substantial space between packages or between the packages and the container.

10. The method of claim 8, wherein in the step of separating the carton into two containers, the packages fill each container such that a side walls of each exposed package is coplanar to a newly created top edge of each sidewall of each container.

11. The method of claim 8, wherein in the step of providing a shipping carton, the first and second pull tab is formed in at least one of the plurality of walls of the carton.

12. The method of claim 8, wherein in the step of providing a shipping carton, pull indicia is provided on a wall adjacent at least one of the first and second pull tabs.

13. The method of claim 8, wherein the tear strip comprises a continuous internal tear strip which includes no perforations into the plurality of walls of the carton.

14. The method of claim 8, further comprising a step of determining a location of the internal tear strip in the absence of perforations in the shipping carton's walls.

15. The method of claim 8, further comprising a step of moving the shipping carton into a position for separation of the shipping carton into separate containers via the pull indicia such that the packages of sheet products contained therein will not move out of each separate container as the shipping carton is opened.

* * * * *